US006240708B1

(12) United States Patent
Kassouni

(10) Patent No.: US 6,240,708 B1
(45) Date of Patent: Jun. 5, 2001

(54) METHOD OF PACKAGING PHARMACEUTICALS

(76) Inventor: Haig H. Kassouni, 7409 Kenrob SE., Grand Rapids, MI (US) 49546

( * ) Notice: Subject to any disclaimer, the term of this patent is extended or adjusted under 35 U.S.C. 154(b) by 0 days.

(21) Appl. No.: 09/661,395

(22) Filed: Sep. 13, 2000

Related U.S. Application Data

(62) Division of application No. 09/460,968, filed on Dec. 14, 1999, now Pat. No. 6,164,471.

(51) Int. Cl.[7] ..... B65B 7/28; B65B 61/00

(52) U.S. Cl. ..... 53/420; 53/422; 53/489; 53/490

(58) Field of Search ..... 53/420, 421, 422, 53/489, 490

(56) References Cited

U.S. PATENT DOCUMENTS

| | | | |
|---|---|---|---|
| 704,482 | | 7/1902 | Livingstone . |
| 2,751,073 | | 6/1956 | Sheeran . |
| 2,880,900 | | 4/1959 | Foye . |
| 3,010,570 | | 11/1961 | Sundstrom . |
| 3,169,654 | | 2/1965 | Pollklesener . |
| 3,604,178 | * | 9/1971 | Bluhm ..... 53/422 |
| 3,703,975 | | 11/1972 | Wittemer . |
| 3,863,795 | | 2/1975 | Mills . |
| 3,998,349 | | 12/1976 | Megowen . |
| 4,215,786 | | 8/1980 | Vertes . |
| 4,279,351 | | 7/1981 | Vertes . |
| 4,340,138 | | 7/1982 | Bernhardt . |
| 4,416,382 | | 11/1983 | Lawrence et al. . |
| 4,432,462 | * | 2/1984 | Newkirk ..... 53/420 |
| 4,697,719 | | 10/1987 | Allen . |
| 4,706,837 | | 11/1987 | Cooke . |
| 4,819,819 | | 4/1989 | Robertson, Jr. . |
| 4,848,615 | | 7/1989 | Friedrich . |
| 4,872,571 | | 10/1989 | Crecelius et al. . |
| 5,012,946 | | 5/1991 | McCarthy . |
| 5,018,621 | | 5/1991 | O'Connell, Jr. . |
| 5,064,073 | | 11/1991 | Folland . |
| 5,096,078 | | 3/1992 | McQueeny . |
| 5,101,993 | | 4/1992 | Nairn et al. . |
| 5,103,990 | | 4/1992 | Irwin . |
| 5,119,964 | | 6/1992 | Witt . |
| 5,121,845 | | 6/1992 | Blanchard . |
| 5,156,286 | | 10/1992 | Piccard . |
| 5,415,306 | | 5/1995 | Luch et al. . |
| 5,673,807 | | 10/1997 | Valyi . |
| 5,695,870 | | 12/1997 | Kelch et al. . |
| 5,813,563 | | 9/1998 | Boehm et al. . |
| 5,893,477 | | 4/1999 | Kaneko et al. . |
| 6,082,568 | | 7/2000 | Flanagan . |

FOREIGN PATENT DOCUMENTS

| | | |
|---|---|---|
| 2753239 | 6/1979 | (DE) . |
| 1339263 | 1/1964 | (FR) . |
| 1488306 | 10/1967 | (FR) . |
| 1329603 | 9/1973 | (GB) . |

* cited by examiner

*Primary Examiner*—John Sipos
(74) *Attorney, Agent, or Firm*—Price, Heneveld, Cooper, DeWitt & Litton

(57) ABSTRACT

A container assembly having a container, an insert and a cap. The container has a sidewall extending upwardly to a rim which circumscribes an opening in the top of the container. The insert is located in the opening in the top of the container and is formed of a substantially thin sheet of material. The insert includes an annular lip engaging the rim of the container, a body projecting downwardly from the lip into the container and a tab projecting laterally from the lip away from the body of the insert. The body of the insert has a downwardly extending sidewall which diverges away from the sidewall of said container as it progresses downwardly with the sidewall of the body terminating at a bottom wall. The lip of the insert is sealed to the rim of the container. The cap for the container seats over the opening and includes a downwardly depending skirt. The tab of the insert has a first portion that projects downwardly from the rim of the container, between the sidewall of the container and the skirt of the cap.

10 Claims, 1 Drawing Sheet

METHOD OF PACKAGING PHARMACEUTICALS

CROSS REFERENCE TO RELATED APPLICATIONS

This application is a divisional of application Ser. No. 09/460,968, filed Dec. 14, 1999, entitled TAMPER PROOF PHARMACEUTICAL CONTAINER, now U.S. Pat. No. 6,164,471.

BACKGROUND OF THE INVENTION

The present invention relates to pharmaceutical containers. In the pharmaceutical industry, containers have been used to store medication for prescription medicine and over-the-counter medicine.

Heretofore, a typical pill container typically included a wad of cotton inserted into the opening of the container because the pills in a typical pill container will not take up all of the space inside of the container. The cotton acts to keep the contents of the container from shifting during shipping and handling of the container, thereby avoiding product disintegration.

After the cotton is inserted into the bottle, a flat top seal is then typically attached to the top rim of the container. The flat top seal serves several functions: it keeps the cotton in the container, it helps keep the contents of the container fresh, and it serves as a security seal. A cap is then placed on the container.

In order to further protect the contents of the container from contamination, either from the environment or from people opening the container to add unwanted substances, a plastic band is typically shrink-wrapped around the cap and the top of the container. The plastic band provides the consumer with a visually perceptible inspection means to determine whether the seal of the container has been broken and the contents of the container have been tainted. The three-step process of filling the empty space in the container with cotton, and adding the two seals, namely the flat top seal and the shrink-wrapped band, is an expensive and relatively lengthy process.

Polymeric bladder type head space fillers have been proposed for pharmaceutical containers for many years, e.g. as in French Patents 1,488,306 and 1,339,263, and U.S. Pat. Nos. 2,880,900, 3,169,654, 3,863,795, 4,215,786, 4,279,351 and 5,096,078. Foil tops with safety seals tabs have been proposed for many years, see e.g. U.S. Pat. Nos. 5,119,964, 5,103,990, 4,697,719 and 4,872,571. However, none of these proposed packaging systems has achieved any common usage in the pharmaceutical packaging field.

Accordingly, a practical, economical packaging system solving the aforementioned disadvantages and having the aforementioned advantages is desired.

SUMMARY OF THE INVENTION

The present invention comprises a method for packaging pharmaceuticals and a container used therein comprising a head space filler with an integral safety seal device. The insert is located in the opening in the top of the container and is formed of a thin sheet of material. The insert includes an annular lip engaging the rim of the container, a body projecting downwardly from the lip into the container and a tab projecting laterally from the lip away from the body of the insert. The body of the insert has a downwardly extending sidewall which diverges away from the sidewall of the container as it progresses downwardly with the sidewall of the body terminating at a bottom wall. The lip of the insert is sealed to the rim of the container. The cap for the container seats over the opening and includes a downwardly depending skirt. The tab of the insert has a first portion that projects downwardly from the rim of the container, between the sidewall of the container and the skirt of the cap.

The principle objects of the present invention are to provide an integral insert for a container assembly that will take the place of cotton in the container. The container assembly also provides evidence of tampering with the seal of the container. Therefore, in one sealing operation, the manufacturer not only seals the top of the filled container, but also provides a space filler which replaces the normal cotton wad. The container is efficient in use, economical to manufacture, capable of a long operable life, and particularly adapted for the proposed use.

These and other features, advantages, and objects of the present invention will be further understood and appreciated by those skilled in the art by reference to the following specification, claims and appended drawings.

DETAILED DESCRIPTION OF PREFERRED EMBODIMENT

Figure 1:
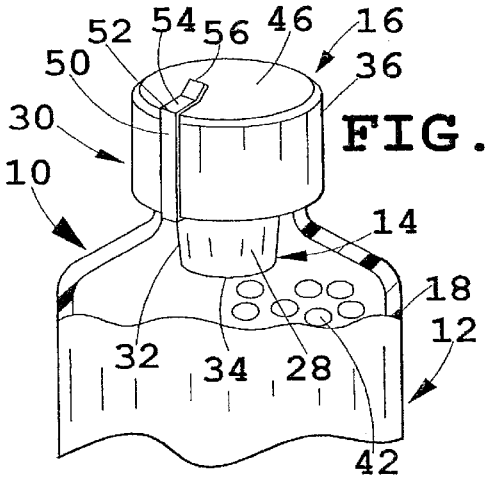
FIG. 1 is a perspective view of a container assembly embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
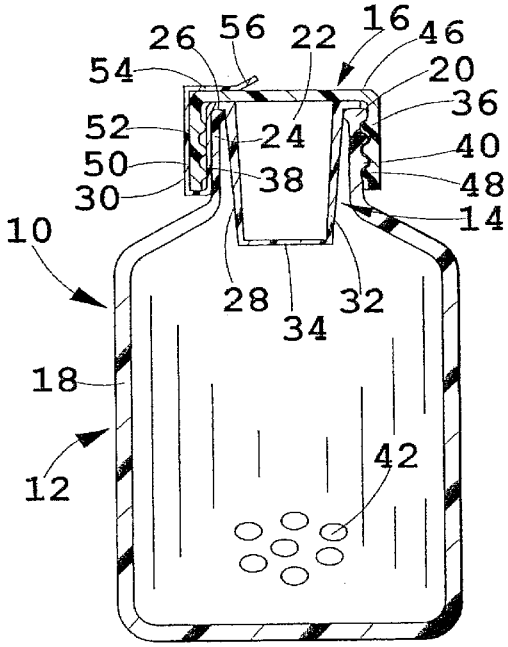
FIG. 3 is a cross-sectional view of the container assembly of the first alternative embodiment of the present invention.
Figure 2:
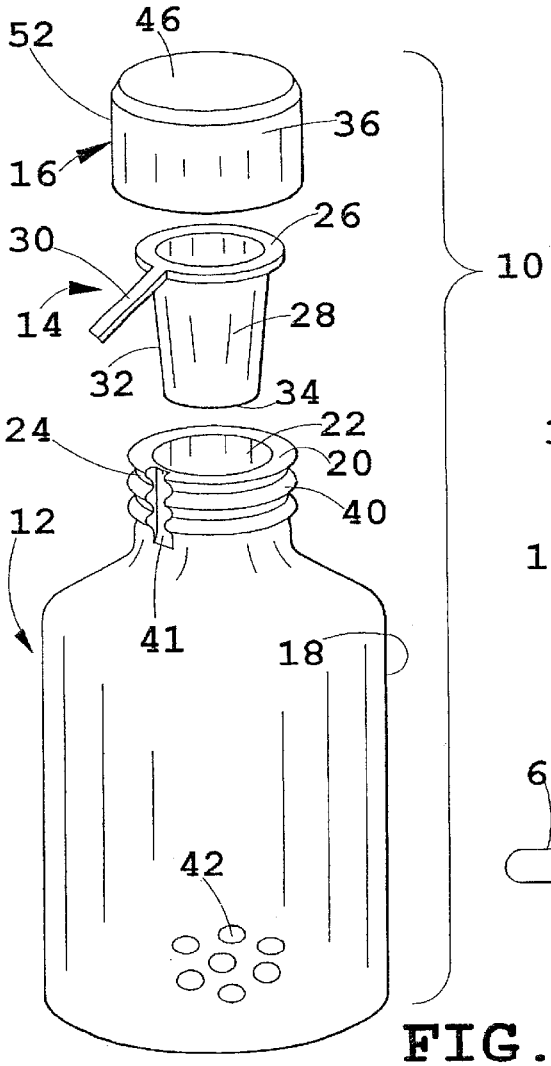
FIG. 2 is an explode view of the container assembly of the present invention.

The reference number 10 (FIGS. 1–3) generally designates a container assembly embodying the present invention. In the illustrated example, the container assembly 10 includes a container 12, an insert 14 and a cap 16. The container 12 has a sidewall 18 extending upwardly to a rim 20 which circumscribes an opening 22 in the top 24 of the container 12. The insert 14 is located in the opening 22 in the top 24 of the container 12 and is formed of a substantially thin sheet of material. The insert 14 includes an annular lip 26 engaging the rim 20 of the container 12, a body 28 projecting downwardly from the lip 26 into the container 12 and a tab 30 projecting laterally from the lip 26 away from the body 28 of the insert 14. The body 28 of the insert 14 has a downwardly extending sidewall 32 which diverges away from the sidewall 18 of the container 12 as it progresses downwardly with the sidewall 32 of the body 28 terminating at a bottom wall 34. The lip 26 of the insert 14 is sealed to the rim 20 of the container 12. The cap 16 for the container 12 seats over the opening 22 and includes a downwardly depending skirt 36. The tab 30 of the insert 14 has a first portion 38 (FIG. 3) that is projected downwardly from the rim 20 of the container 12, between the sidewall 18 of the container 12 and the skirt 36 of the cap 16.

In the illustrated example, the container 12 (FIGS. 1–3) has threads 40 at the top 24 of the container 12 for connection to the cap 16. The container 12 has a channel 41 through the threads 40 for receiving the first portion 38 of the tab 30. It is contemplated that the container 12 can be connected to the cap 16 by other means, including a snap-on connection comprising overlapping ridges on the container 12 and the cap 16, which is commonly used with household medication containers. The container 12 preferably is a common medicine bottle that contains pills 42 or other pharmaceutical medication.

The illustrated body 28 of the insert 14 preferably has a frusta-conical shaped sidewall 32. It is contemplated that the body 28 can have many shapes and many heights, depending on the space requirement in the top 24 of the container 12 and the need to fill the empty space in the container 12. The bottom wall 34 of the insert 14 is preferably planar, although it is contemplated that the bottom wall 34 of the insert 14 can be rounded. The materials used to make the insert 14 are application specific, and are preferably formed foil, thermofoamed molded polymeric film or a semi-permeable membrane. However, the insert 14 is most preferably made out of a thermoplastic film or film foam that has been thermoformed. The insert 14 could also be made out of a combination of any or all of the previously mentioned materials. Moreover, the insert 14 could have multiple layers made out of the previously mentioned materials, or some other application specific multilayer construction or application specific barrier. Likewise, the thickness of the insert varies according to the specific application, with a most preferred thickness of 0.10 inches to 0.15 inches for foam.

The illustrated cap 16 has an annular planar top 46 with the skirt 36 attached to sides of the top 46. The skirt preferably has threads 48 on the inside of the skirt 36 for connecting with the threads 40 at the top 24 of the container 12. The cap 16 could also have overlapping ridges on the inside of the skirt 36 for a snap-on connection with the container 12. The cap 16 is preferably made out of plastic.

In the illustrated example, the container assembly 10 is put together by placing the insert 14 into the opening 22 in the top 24 of the container 12. The body 28 of the insert 12 fits into the opening 22 in the top 24 of the container 12 and the lip 26 of the insert 14 rests on the rim 20 of the container 12. The lip 26 of the insert 14 is then sealed to the rim 20 of the container 12, preferably with a heat activated adhesive. Thereafter, the cap 16 is placed over the opening 22 in the container 12. Preferably, the cap 16 is connected to the top 24 of the container 12 by screwing mating threads 48 on the inside of the skirt 36 with threads 40 on the top 24 of the container 12. As the cap 16 is mated with the top 24 of the container 12, the tab 30 is bent downward through the channel 41 in the threads 40 in the top 24 of the container 12.

In a first preferred embodiment of the invention (FIGS. 1 and 3), after the cap 16 is mated with the top 24 of the container 12 and the tab 30 is bent downward through the channel 41 in the threads 40, the first portion 38 of the tab 30 rests between the sidewall 18 of the container 12 and the inside of the skirt 36 of the cap 16. A second portion 50 of the tab 30, which is connected to the first portion 38 of the tab 30, is then folded upwardly along an outside 52 of the skirt 36 and adhered to the outside 52 of the skirt 38. A security seal is thereby made between the tab 30 and the cap 16 whereby the tab 30 can only be removed from the cap 16 by breaking the security seal. Subsequently, a third portion 54 of the tab 30, which is connected to the second portion 50 of the tab 30, is folded projected laterally across the top 46 of said cap 16 and adhered thereto. Alternatively, the second portion 50 of the tab 30 is not adhered to the outside 52 of the skirt 36 and the security seal is formed between the third portion 54 of the tab 30 and the top 46 of the cap 16. A non-adhesive pull-strip portion 56, which is connected to the third portion 54 of the tab 30, extends away from the top 46 of the cap 16. The non-adhesive pull-strip portion 56 is left free of adhesive to provide a convenient pull-tab for breaking the security seal, and also for allowing easy removal of the tab 30 from the cap 16.

The container assembly 10 in the first preferred embodiment of the invention can be opened by grabbing the non-adhesive pull-strip portion 56 and pulling the third portion 54 of the tab 30 away from the top 46 of the cap 16, thereby separating the tab 30 from the top 46 of the cap 16. The non-adhesive pull-strip portion 56 of the tab 30 is then pulled away from the outside 52 of the skirt 36 separating the second portion 50 of the tab 30 from the skirt 36. The cap 16 can then be removed from the container 12, preferably by unscrewing the cap 16. The tab 30 is then used to pull the insert 14 out of the opening 22 in the top 24 of the container 12 allowing access to the contents of the container 12.

Figure 4:
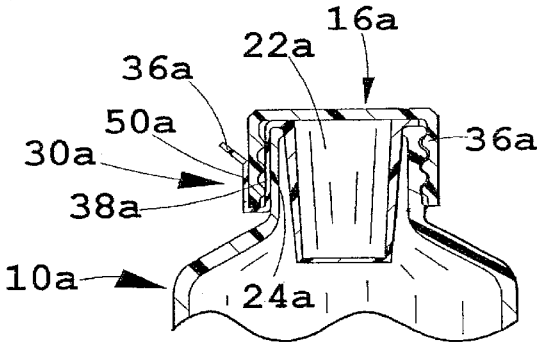
FIG. 4 is a cross-sectional view of the container assembly of the second alternative embodiment of the present invention.

The reference numeral 10*a* (FIG. 4) generally designates a second preferred embodiment of the invention, having a second preferred embodiment of the tab 30*a*. Since container assembly 10*a* is similar to the previously described container assembly 10, similar parts appearing in FIGS. 1–3 and FIG. 4, respectively, are represented by the same, corresponding reference numeral, except for the suffix "a" in the numerals of the latter. In container assembly 10*a*, the tab 30*a* only includes the first portion 38*a* and the second portion 50*a*. The second portion 50*a* of the tab 30*a* in the second preferred embodiment of the invention is adhered to the skirt 36*a*. A non-adhesive pull-strip portion 56*a* of the second preferred embodiment, which is connected to the second portion 50*a* of the tab 30*a*, extends away from the skirt 36*a*. The non-adhesive pull-strip portion 56*a* is left free of adhesive to provide a convenient pull-tab for breaking the security seal, and also for allowing easy removal of the tab 56*a* from said cap 16*a*.

The container assembly 10*a* of the second preferred embodiment can be opened by grabbing the non-adhesive pull-strip portion 56*a* of the tab 30*a* and pulling the second portion 50*a* of the tab 30*a* away from the skirt 36*a*, thereby separating the tab 30*a* from the skirt 36*a*. The cap 16*a* can then be removed from the container 12*a*, preferably by unscrewing the cap 16*a*. The tab 30*a* is then used to pull the insert 14*a* out of the opening 22*a* in the top 24*a* of the container 12*a* allowing access to the contents of the container 12*a*.

Figure 5:
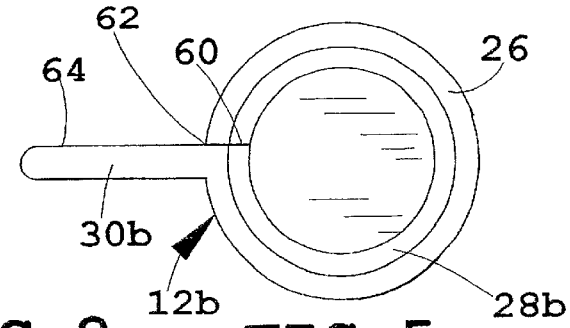
FIG. 5 is a top view of a third alternative embodiment of the insert of the present invention.

The reference numeral 14*b* (FIG. 5) generally designates another embodiment of the present invention, having a third preferred embodiment for the insert. Since insert 14*b* is similar to the previously described insert 14, similar parts appearing in FIG. 3 and FIG. 5, respectively, are represented by the same, corresponding reference number, except for the suffix "b" in the numerals of the latter. The insert 14*b* includes a weakened line of material 60 extending from a base 62 of at least one side edge 64 of the tab 30*b*, through the lip 26*b* and at least partially into the downwardly projecting body 28*b*. Therefore, when the tab 30*b* is used to pull the insert 14*b* out of the opening 22 in the top 24 of the container 12, the insert 14*b* is torn along the weakened line of material 60. The weakened line of material thereby provides evidence of tampering because the insert will be torn if the container 12 is opened. In a preferred embodiment, two weakened lines of material 60 are located at the base 62 of the tab 30*b* at each of the side edges 64, thereby tearing the insert 14*b* along two substantially parallel weakened lines of material 60. The weakened line of material 60 of the third preferred embodiment can be employed on the insert 14 of the first preferred embodiment or on the insert 14*a* of the second preferred embodiment.

In the forgoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method of packaging pharmaceuticals comprising:

providing a container having a sidewall extending upwardly to a rim which circumscribes an opening in the top of said container;

filling said container with pharmaceuticals;

locating an insert in said opening, said insert being formed of a substantially thin sheet of material, and including an annular lip engaging said rim, with a body projecting downwardly from said lip, into said container, and a tab projecting laterally from said lip, away from said body; said body of said insert comprising a downwardly extending sidewall which diverges away from said sidewall of said container as it progresses downwardly, said sidewall of said body terminating at a bottom wall;

sealing said lip to said rim of said container;

providing a cap for said container which seats over said opening, said cap including a downwardly depending skirt; and projecting a first portion of said tab of said insert downwardly from said rim of said container, between said sidewall of said container and said skirt of said cap.

2. The method of packaging pharmaceuticals of claim 1 further comprising:

weakening said insert along a line extending from a base of at least one side edge of the tab, through said lip and at least partially into said downwardly projecting body, whereby said insert is torn along said line when said insert is removed from said container, thereby providing evidence of tampering.

3. The method of packaging pharmaceuticals of claim 1 in which said first portion of said tab is projected downwardly from said rim to a bottom of said skirt; wherein a second portion of said tab is attached to said first portion of said tab and is projected upwardly from said bottom of said skirt adjacent an outside of said skirt.

4. The method of packaging pharmaceuticals of claim 3 further comprising:

adhering said second portion of said tab to said outside of said skirt.

5. The method of packaging pharmaceuticals of claim 4 further comprising:

attaching a non-adhesive pull-strip portion to said second portion of said tab; whereby said non-adhesive pull-strip portion is unattached to the cap to allow easy removal of said tab from said cap.

6. The method of packaging pharmaceuticals of claim 3 in which said second portion of said tab is projected upwardly from said bottom of said skirt to a top of said skirt; wherein a third portion of said tab is attached to said second portion of said tab and is projected laterally adjacent a top of said cap.

7. The method of packaging pharmaceuticals of claim 6 further comprising:

adhering said third portion of said tab to said top of said cap.

8. The method of packaging pharmaceuticals of claim 7 further comprising:

attaching a non-adhesive pull-strip portion to said third portion of said tab; whereby said non-adhesive pull-strip portion is unattached to the cap to allow easy removal of said tab from said cap.

9. The method of packaging pharmaceuticals of claim 1 in which said step of sealing said lip to said rim of said container comprises sealing with a heat activated adhesive.

10. The method of packaging pharmaceuticals of claim 1 in which said insert is made of a thermoplastic.

* * * * *